US011598192B1

(12) United States Patent
Quero

(10) Patent No.: US 11,598,192 B1
(45) Date of Patent: Mar. 7, 2023

(54) METHODOLOGY TO CONSOLIDATE SAND OR PROPPANT WITH RESIN IN TWO STEPS

(71) Applicant: Halliburton Energy Services, Inc., Houston, TX (US)

(72) Inventor: Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/589,129

(22) Filed: Jan. 31, 2022

(51) Int. Cl.

| | |
|---|---|
| ***E21B 43/26*** | (2006.01) |
| ***E21B 33/12*** | (2006.01) |
| ***E21B 43/267*** | (2006.01) |
| ***E21B 43/27*** | (2006.01) |

(52) U.S. Cl.
CPC ..... *E21B 43/261* (2013.01); *E21B 33/12* (2013.01); *E21B 43/267* (2013.01); *E21B 43/27* (2020.05)

(58) Field of Classification Search
CPC ..... E21B 43/261; E21B 43/27; E21B 33/12; E21B 43/267
See application file for complete search history.

(56) References Cited

U.S. PATENT DOCUMENTS

| | | | | |
|---|---|---|---|---|
| 2003/0131999 | A1* | 7/2003 | Nguyen | C09K 8/805 507/924 |
| 2004/0000402 | A1* | 1/2004 | Nguyen | C09K 8/805 507/924 |
| 2005/0274522 | A1* | 12/2005 | Surjaatmadja | E21B 43/26 166/308.1 |
| 2012/0305679 | A1* | 12/2012 | Surjaatmadja | E21B 43/114 239/589 |
| 2014/0262294 | A1* | 9/2014 | Sanders | E21B 43/267 166/308.2 |
| 2016/0145989 | A1* | 5/2016 | Ferguson | E21B 43/14 166/281 |
| 2016/0280990 | A1* | 9/2016 | Lieng | E21B 43/04 |
| 2017/0138150 | A1* | 5/2017 | Yencho | E21B 43/26 |

OTHER PUBLICATIONS

Hexion, PropCure™ On-the-fly Curable Resin Coating, Accessed Jan. 2022. Available at https://www.hexion.com/en-us/brand/propcure-on-the-fly-curable-resin-coating.

* cited by examiner

*Primary Examiner* — Silvana C Runyan
(74) *Attorney, Agent, or Firm* — Thomas Rooney; C. Tumey Law Group PLLC

(57) ABSTRACT

Systems and methods are directed to proppant flowback control. A method includes coating resin onto proppant at a well site and pumping the coated proppant into a wellbore during a fracking operation. The method further includes pumping an activator for the resin into the wellbore to displace the coated proppant into at least one fracture during the fracking operation. The pumping of the coated proppant and the pumping of the activator are performed separately.

20 Claims, 6 Drawing Sheets

METHODOLOGY TO CONSOLIDATE SAND OR PROPPANT WITH RESIN IN TWO STEPS

BACKGROUND

Hydrocarbon producing wells may be stimulated by hydraulic fracturing treatments. In hydraulic fracturing treatments, a fracturing fluid is pumped into a producing zone of a subterranean formation such that one or more fractures are formed in the zone. Proppant, such as sand, for propping the fractures is suspended in the fracturing fluid such that the proppant is deposited in the fractures.

The proppant in the fractures prevents the fractures from closing resulting in conductive channels to produce formation fluid. However, many hydraulically fractured wells, especially unconventional wells, are facing proppant flowback issues, impacting production and damaging equipment.

BRIEF DESCRIPTION OF THE DRAWINGS

These drawings illustrate certain aspects of some of the examples of the present disclosure and should not be used to limit or define the disclosure.

DETAILED DESCRIPTION

Figure 1A:
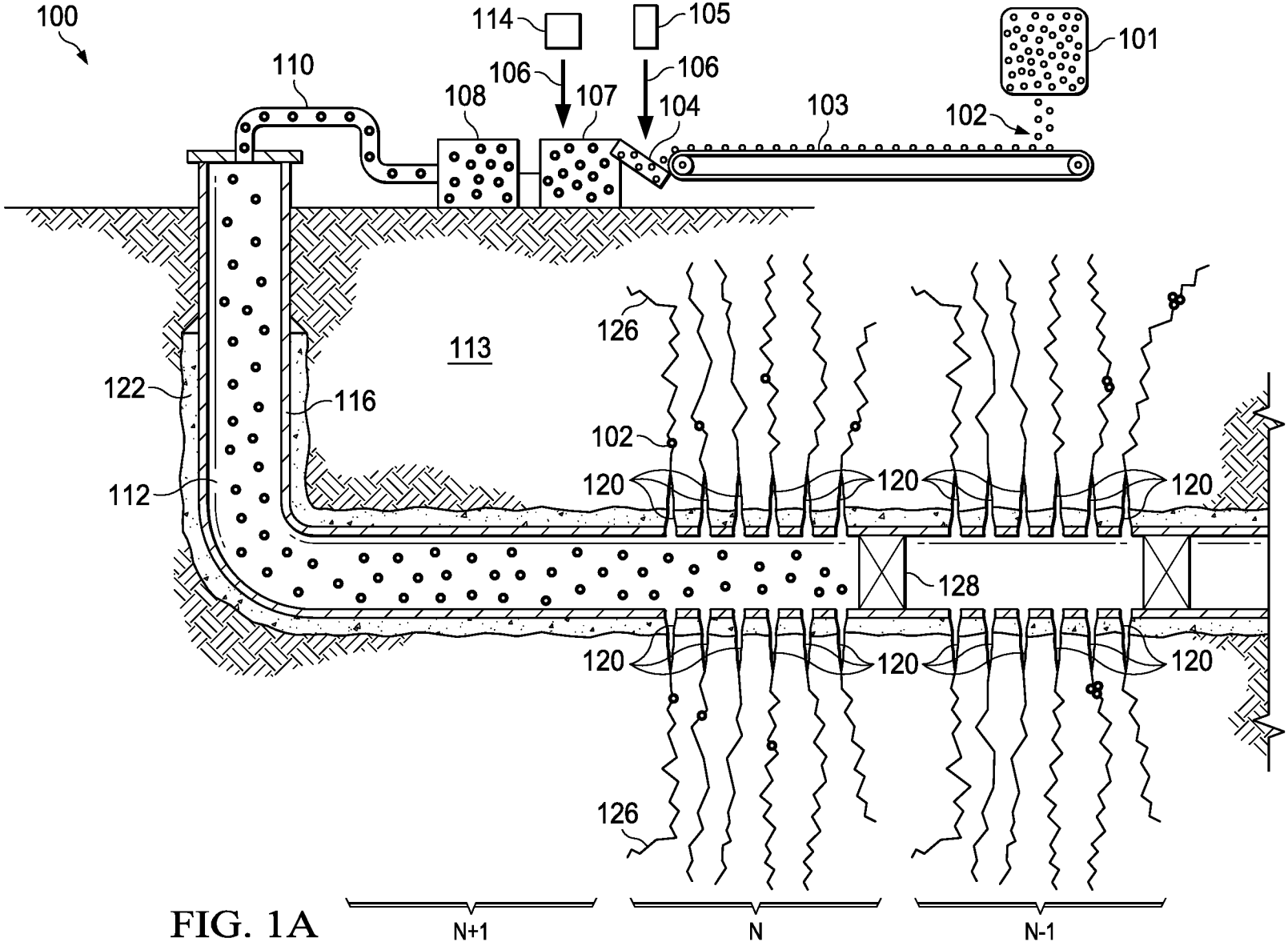
FIG. 1A illustrates an example of a system that may be used to coat the proppant with resin, hydraulically fracture a subterranean formation with coated proppant, and activate the resin, in accordance with examples of the present disclosure.

Methods of the present disclosure generally relate to treating a wellbore with a resin and its activator to reduce proppant flowback. The resin and the activator may be pumped into the wellbore in two steps allowing equipment (e.g., pumping/mixing equipment) to remain free of cured resin. Thus, cleaning of the equipment at the surface of the well may not be required. While the methods may be used in a variety of formations, they may be particularly beneficial in unconventional formations, such as shale formations, to prevent proppant flowback.

The methods may be performed during fracking, a plug and perf completion, and/or milling of a plug. The resin may be dry-coated or wet-coated onto proppant (e.g., sand) at, for example, a well site. For example, the dry-coating may occur on a sand screw via a spray. As the sand passes through the sand screw, the sand may be sprayed with the resin, and then the coated sand may pass into mixing equipment such as, for example, a frac tub that may include a blender used for fracking.

Wet-coating may occur in the mixing equipment. For example, the sand may pass into the mixing equipment where the sand is blended with the resin resulting in coated sand. After coating of the sand with the resin via a wet coat or a dry coat, the coated sand may be pumped into a wellbore to hydraulically fracture a subterranean formation. The resin can be pumped safely without the risk of curing in equipment. Then, towards the end of a hydraulic fracturing operation, the activator may be added to the mixing equipment to flush/displace the coated sand from the wellbore into fractures extending from the wellbore into the subterranean formation. For example, stage N may be fractured with the coated sand and then the coated sand may be displaced/flushed from the wellbore into clusters of the fractures of the stage N, with the activator, toward the end of the fracking operation.

In some examples, the activator may be pumped into the wellbore during a plug and perf operation. Plug and perf refers to a cased hole completion procedure that pumps down a plug and perforation gun to a desired stage in a wellbore. Once the plug is set, the perf gun fires into the casing, penetrating the subterranean section between the set plugs. Then hydraulic fracturing occurs, and frac fluid is pumped into this section.

The process is repeated for each stage, until all the stages have been hydraulically fractured. Then, the plugs are drilled or milled out. For example, after fracking with the coated sand, the activator may be pumped into the wellbore followed by a plug, such as a frac plug or bridge plug for example, attached to a perforating apparatus. The perforating apparatus may be pumped down the wellbore to displace the activator into the clusters of fractures in the subterranean formation.

The activator may be slightly displaced into the formation. After setting the plug, the perforating apparatus may detach from the plug to perforate another stage (e.g., N+1) for subsequent hydraulic fracking with the proppant coated with the resin. For example, the perforating apparatus may be pulled up-hole to perforate N+1. The process may be repeated for any number of stages.

In other examples, the activator may be pumped into the wellbore during milling out of the plug(s), for example, via coiled tubing (CT), hydraulic workover (HWO), or a drilling rig. Non-limiting examples of the resin include but are not limited to a two component epoxy based resin; a novolak resin; a polyepoxide resin; a phenol-aldehyde resin; a urea-aldehyde resin; a urethane resin; a phenolic resin; a furan resin; a furan/furfuryl alcohol resin; a phenolic/latex resin; a phenol formaldehyde resin; a polyester resin; a hybrid polyester resin; a polyester copolymer resin; a polyurethane resin; a hybrid polyurethane resin; a polyurethane copolymer resin; an acrylate resin; and any combination thereof.

Non-limiting examples of the resin activator include an acid such hydrochloric acid, citric acid, malic acid, tartaric acid, acetic acid, phosphoric acid, maleic acid, lactic acid, ascorbic acid, acetic acid, carbonic acid, succinic acid, and/or benzoic acid. In some examples, an ester may be used as the activator.

FIG. 1A illustrates an example of a frac system 100, in accordance with examples of the present disclosure. The system 100 may be used for coating the sand with resin and pumping the coated sand into a wellbore and then pumping the activator into the wellbore during a fracking operation. The system 100 includes a proppant source 101 (e.g., a container) to provide (e.g., via gravity feed, valve) proppant 102 (e.g., sand) onto a conveyor system 103 (e.g., a conveyor belt with rollers) to transport the proppant 102 to a sand screw 104.

Coating of the proppant 102 may occur via dry-coating or wet-coating. During dry-coating of the proppant 102, a spray unit 105 (e.g., nozzles, pump, and resin source) may spray resin 106 onto the proppant 102 to encapsulate the proppant 102 while the proppant 102 passes through the sand screw 104. The system may also include mixing equipment 107 (e.g., a frac tub) coupled to pumping equipment 108, and a wellbore supply conduit 110 coupled to a wellbore 112 extending into a subterranean formation 113. Alternatively, during wet coating of the proppant 102, the resin 106 may be disposed into the mixing equipment 107 from a container 114 via valves or gravity feed, for example. Each particle of the proppant 102 may be completely covered with resin 106.

Non-limiting examples of the resin include but are not limited to a two component epoxy based resin; a novolak resin; a polyepoxide resin; a phenol-aldehyde resin; a urea-aldehyde resin; a urethane resin; a phenolic resin; a furan resin; a furan/furfuryl alcohol resin; a phenolic/latex resin; a phenol formaldehyde resin; a polyester resin; a hybrid polyester resin; a polyester copolymer resin; a polyurethane resin; a hybrid polyurethane resin; a polyurethane copolymer resin; an acrylate resin; and any combination thereof.

The wellbore 112 may include unconventional and/or conventional wells including horizontal, vertical, slanted, curved, and/or other types of wellbore geometries and orientations. In some examples, coiled tubing may be used to fracture the well. The system 100 may be implemented offshore or onshore. The wellbore 112 may include casing 116 that may be cemented within the wellbore 112 by cement sheath 122. Perforations 120 may extend from the casing 116, through the cement sheath 122, and into the formation 113. The pumping equipment 108 may be fluidly coupled with the mixing equipment 107 and the wellbore supply conduit 110 to communicate various fluids/material into the wellbore 112.

The proppant 102 (e.g., sand) may be mixed with a fluid such as for example an aqueous base fluid via the mixing equipment 107, thereby forming a treatment fluid such as for example a fracturing fluid that may be pumped via the pumping equipment 108 from the mixing equipment 107 down the wellbore 112 at or above a fracture gradient of the subterranean formation 113 to create (or enhance) at least one fracture (e.g., clusters 126) extending from the perforations 120.

Stage N can refer to the current stage in the wellbore 112 for treatment. Stage N−1 can refer to the previously treated stage and Stage N+1 can refer to the subsequent stage for treatment. Plugs 128 may separate each stage. Plugs 128 may include frac plugs or bridge plugs.

The wellbore 112 may include dozens to hundreds of stages, each stage may include 6-12 clusters, for example. Each stage may extend 200 feet along the wellbore 112 from plug to plug, for example. Each cluster 126 may be spaced apart about 20 feet in some examples and include a cluster width of about 1 foot for each cluster.

Figure 1B:
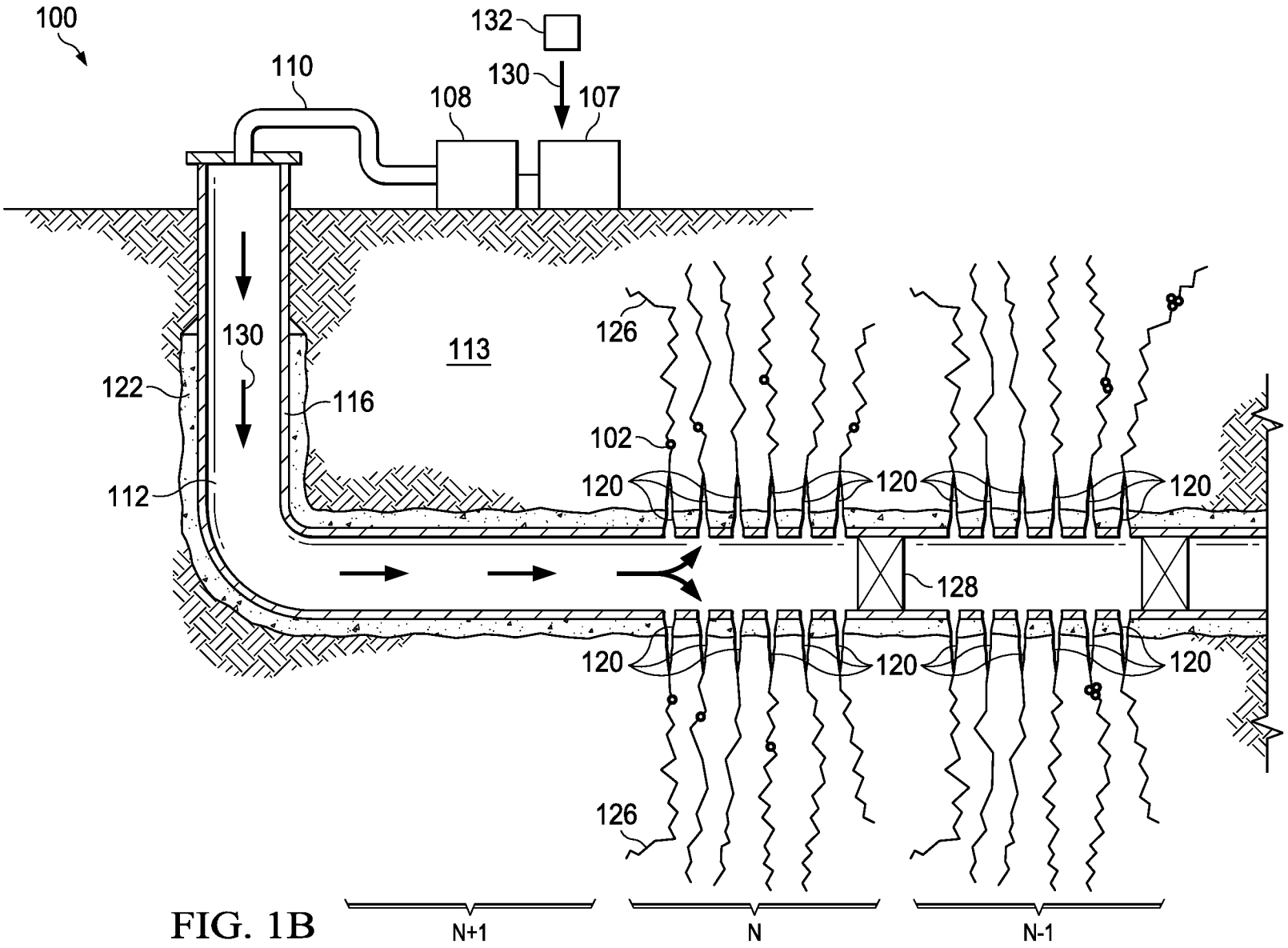
FIG. 1B illustrates disposal of a resin activator into a wellbore during a fracking operation, in accordance with examples of the present disclosure.

FIG. 1B illustrates an addition of an activator 130 to the system 100, towards the end of the fracking operation, in accordance with examples of the present disclosure. The activator 130 may be added to the mixing equipment 107 (e.g., a frac tub) to flush/displace the proppant 102 from the wellbore 112 into clusters 126 extending from the wellbore 112 into the subterranean formation 113.

The activator 130 may be dispensed from a container 132 via a valve for example, into the mixing equipment 107. Other components such as liquids may be added to the mixing equipment 107. Some non-limiting examples of the other components include friction reducers and/or water. Non-limiting examples of the activator 130 include an acid such hydrochloric acid, citric acid, malic acid, tartaric acid, acetic acid, phosphoric acid, maleic acid, lactic acid, ascorbic acid, acetic acid, carbonic acid, succinic acid, and/or benzoic acid. In some examples, an ester may be used as the activator.

Figure 2A:
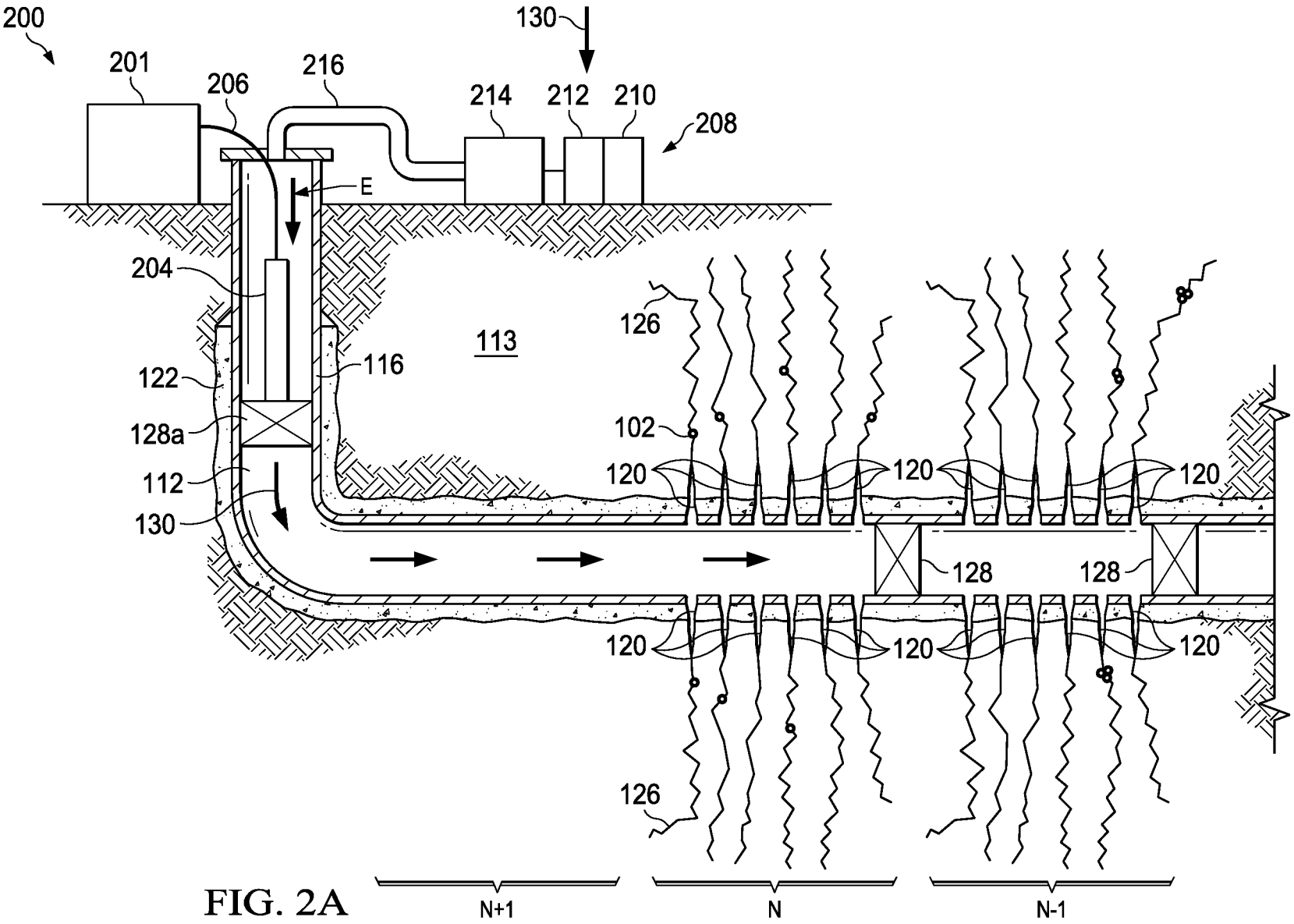
FIG. 2A illustrates a plug and perf system for disposal of the activator into the wellbore, in accordance with examples of the present disclosure.

FIG. 2A illustrates a pump down system 200 including perforating equipment 201 for a plug and perf method, in accordance with examples of the present disclosure. The system 200 may be implemented offshore or onshore. The perforating equipment 201 may include a spool/reel and/or controller to lower/raise and fire the perforating apparatus 204 as desired via a conveyance 206 such as for example, wireline, slickline, or coiled tubing.

The pump down system 200 further includes a fluid handling system 208, which may include a fluid supply 210, mixing equipment 212, pumping equipment 214, and a wellbore supply conduit 216 coupled to the wellbore 112 extending into a subterranean formation 113. The activator 130 may be added to the pump down system 200 (e.g., via the fluid supply 210 or the mixing equipment 212) for disposal into the wellbore 112 prior to performing the plug and perf. The system 200 may be exclusive of the system 100 of FIGS. 1A and 1B.

For example, after stage N is fractured with the proppant 102, the activator 130 (e.g., any suitable acid or ester) may be pumped into the wellbore 112 via the pump down system 200. For example, the activator 130 may be added to the fluid supply 210 or the mixing equipment 212 for disposal into the wellbore 112. Then, a plug 128*a* (e.g., a frac plug or bridge plug) attached to the perforating apparatus 204 may be pumped down the wellbore 108 with fluid E (e.g., brine). The plug 128*a* and/or the perforating apparatus 204 may be used to displace the activator 130 into the clusters 126. Amounts of the activator 130 (or other components pumped into the wellbore) may vary and may be adjusted as desired. Volume is a function of consolidation degree and number of perforations. As an example, 500 gals of the activator 130 can be used. E is the displacement fluid that may be equal at least to the wellbore volume above the plug 128*a* at its placement location.

Figure 2B:
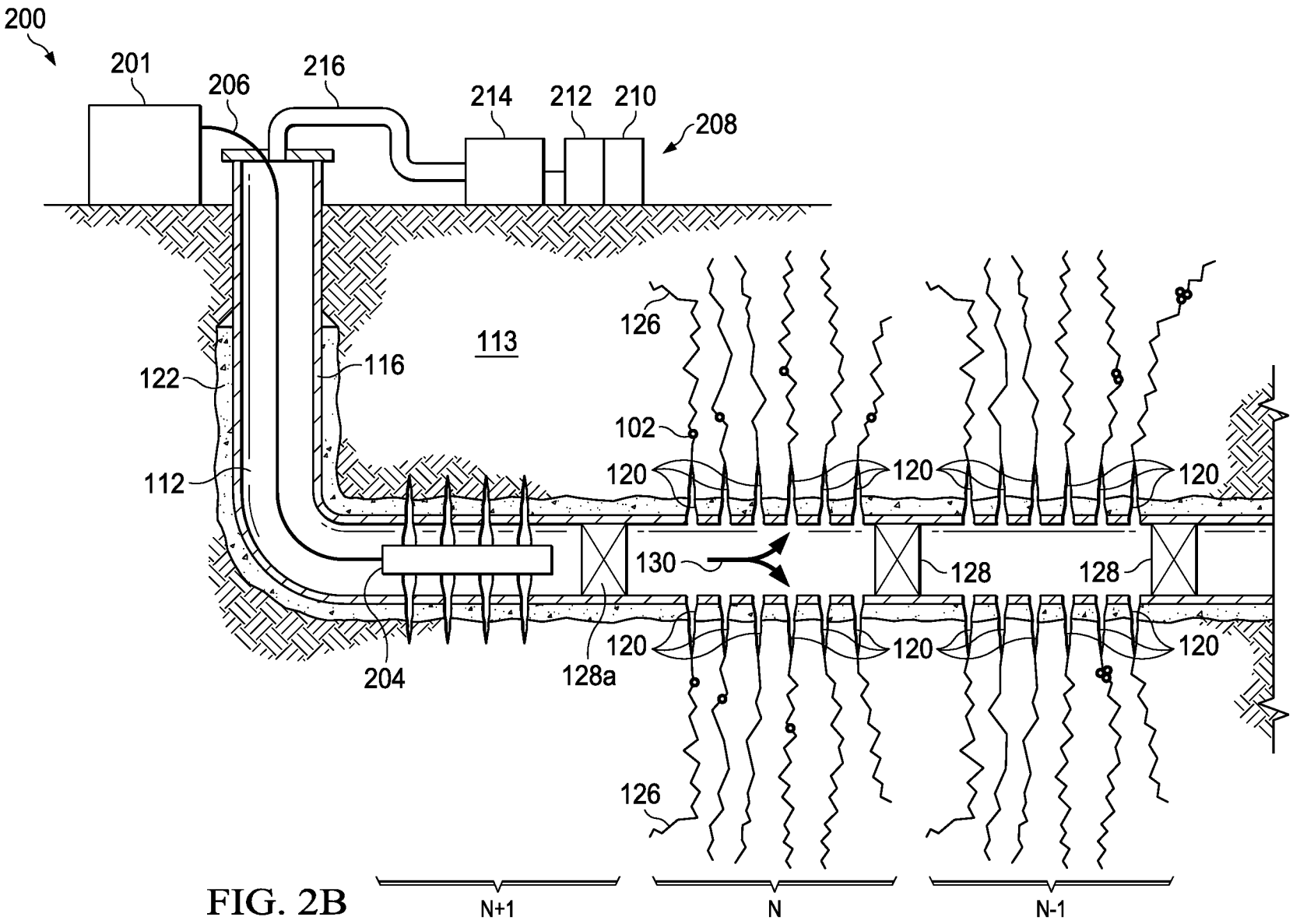
FIG. 2B illustrates setting of a plug during a plug and perf operation, in accordance with examples of the present disclosure.

FIG. 2B illustrates setting of the plug 128*a* and perforating the stage N+1, in accordance with examples of the present disclosure. The plug 128*a* may set between stages N and N+1, and the perforating apparatus 204 may detach (e.g., via an electrical signal) from the plug 128*a* and be pulled up-hole to a target location. While FIG. 2B illustrates stage N+1 as being a proximal stage being up-hole from stage N, embodiments also encompass N+1 being a distal stage being further downhole from stage N.

In some examples, a setting tool may detach the plug 128*a* from the perforating apparatus 204. After detachment from the plug 128*a*, the perforating apparatus 204 may subsequently perforate stage N+1 of the wellbore 112, for example, in 30-foot increments. The activator may be slightly displaced into the formation surrounding stage N and any previously treated stages.

The aforementioned plug and perf process may be repeated for any number of stages. For example, stage N−1 was previously treated in accordance with techniques of the present disclosure. Each stage may soak in the activator and the activator may be slightly displaced into the formation. The resin may consolidate the proppant 102 and harden during activation. This provides mitigation of proppant flowback into the wellbore 112.

Figure 3:
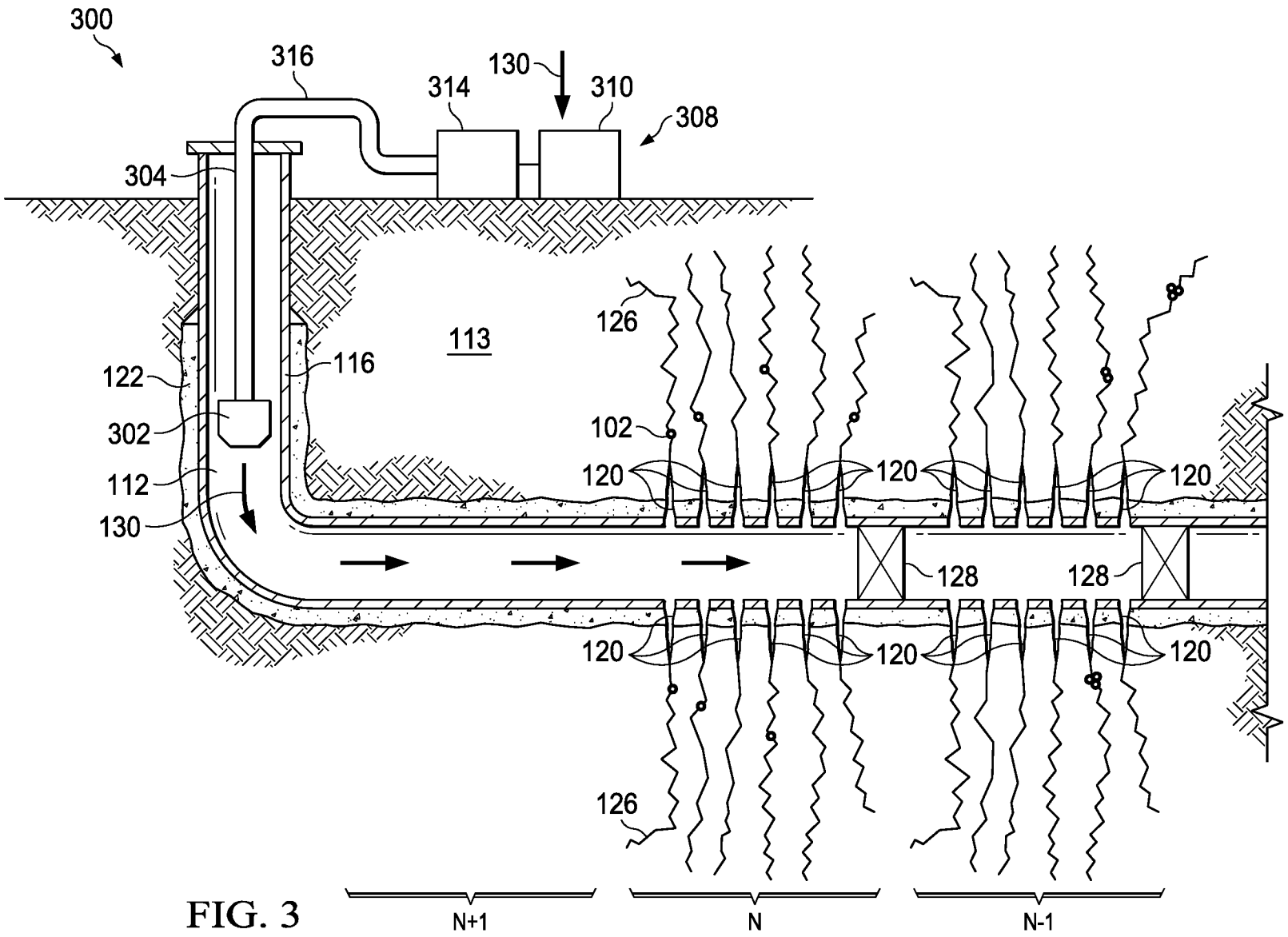
FIG. 3 illustrates disposal of the activator into the wellbore during a milling operation to remove the plug, in accordance with examples of the present disclosure.

FIG. 3 illustrates a system 300 for pumping the activator 130 into the wellbore 112 during milling of a plug 128, in accordance with examples of the present disclosure. A bit 302 for milling may be disposed in the wellbore 112 via a conveyance 304 such as coiled tubing (CT) or a drill string, for example. In some examples, milling may occur via a hydraulic workover (HWO). The system 300 further includes a fluid handling system 308, which may include a fluid supply 310, pumping equipment 314, and a wellbore supply conduit 316 coupled to the wellbore 112 extending into a subterranean formation 113.

The activator 130 may be added to the system 300 via the fluid supply 310. For example, the activator 130 may be disposed into the supply 310 for pumping through the bit 302 during a milling operation to remove the plug 128. The activator 130 may contact/activate the proppant 102 in the clusters 126, for sand consolidation.

Figure 4:
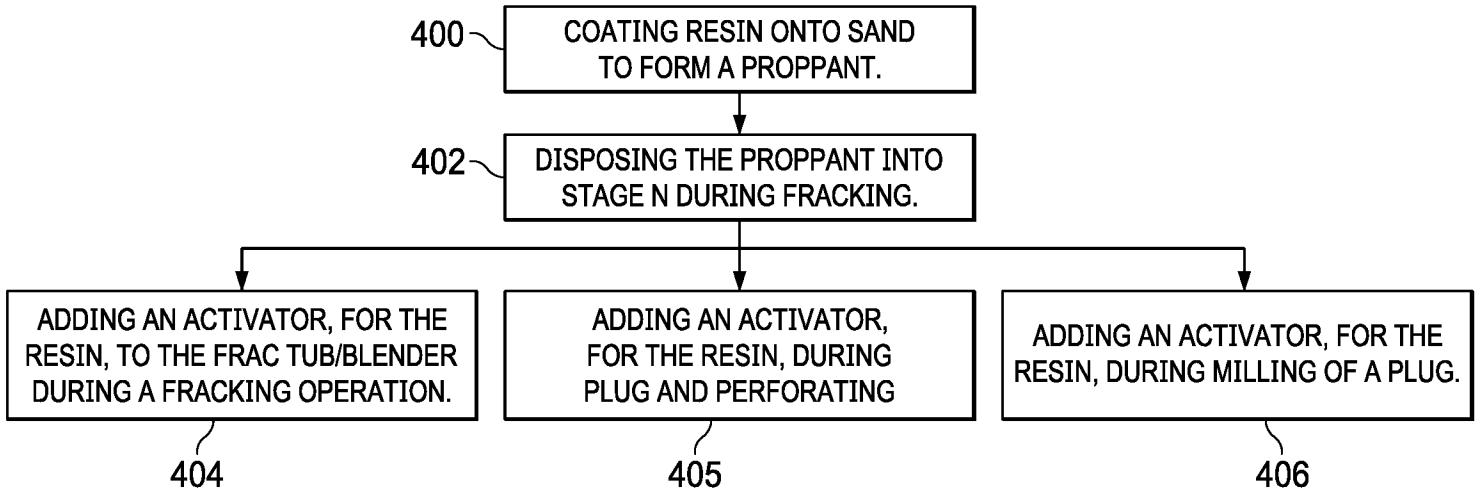
FIG. 4 illustrates an operative sequence for proppant flowback control, in accordance with examples of the present disclosure.

FIG. 4 illustrates an operative sequence for proppant flowback control, in accordance with examples of the present disclosure. At step 400, the resin may be dry-coated or wet-coated onto proppant (e.g., see FIG. 1A). For example, the dry-coating may occur on a sand screw via a spray. For example, as the sand passes through the sand screw, the sand may be sprayed with the resin, and then the coated sand may pass into mixing equipment from the sand screw. Wet-coating may occur in the mixing equipment. For example, the sand may pass into the mixing equipment where the sand is blended with the resin resulting in coated sand. Other components such as for example, water and/or friction reducers may be present in the mixing equipment.

At step 402, after coating of the sand with the resin via a wet coat or a dry coat, the coated sand may be pumped into a wellbore to hydraulically fracture a subterranean formation. For example, proppant may be disposed in the well during fracturing of stage N (e.g., see FIG. 1A). The proppant may be mixed with a fluid such as for example an aqueous base fluid via the mixing equipment, thereby forming a treatment fluid such as for example a fracturing fluid that may be pumped via the pumping equipment from the fluid supply down the wellbore at or above a fracture gradient of the subterranean formation to create (or enhance) at least one fracture (e.g., clusters 126) extending from the perforations.

At step 404, towards the end of a hydraulic fracturing operation ("call flush"), the activator may be added to the mixing equipment to flush/displace the coated sand from the wellbore into clusters of fractures extending from the wellbore into the subterranean formation. For example, the coated sand may be displaced from the wellbore into the clusters of the fractures of the stage N, with the activator, toward the end of the fracking operation (e.g., see FIG. 1B). The activator may be pumped with a liquid such as water, for example.

Alternatively, at step 405, the activator may be pumped into the wellbore during a plug and perf operation (e.g., see FIGS. 2A and 2B). Plug and perf refers to a cased hole completion procedure that pumps down a plug and perforation gun to a desired stage in a wellbore. Once the plug is set, the perf gun fires into the casing, penetrating the subterranean section between the set plugs. Then hydraulic fracturing occurs, and frac fluid is pumped into this section. The process is repeated for each stage, until all the stages have been hydraulically fractured. Then, the plugs are drilled or milled out.

For example, after fracking with the coated sand, the activator may be pumped into the wellbore followed by a plug, such as a frac plug or bridge plug for example, attached to a perforating apparatus. The perforating apparatus may be pumped down the wellbore to displace the activator into the clusters of fractures in the subterranean formation. The activator may be slightly displaced into the formation. Each stage may soak in the activator (e.g., an acid or ester) and the activator may be slightly displaced into the formation.

After setting the plug, the perforating apparatus may detach from the plug to perforate another stage (e.g., N+1) for subsequent hydraulic fracking with the proppant coated with the resin. For example, the perforating apparatus may be pulled up-hole to perforate N+1. The plug may set between stages N and N+1, and the perforating apparatus may detach (e.g., via an electrical signal) from the plug and be pulled up-hole to a target location. In some examples, a setting tool may detach the plug 1 from the perforating apparatus.

After detachment from the plug, the perforating apparatus may subsequently perforate stage N+1 of the wellbore, for example, in 30-foot increments. The activator may be slightly displaced into the formation surrounding stage N and any previously treated stages. The process may be repeated for any number of stages.

Alternatively, at step 406, the activator may be pumped into the wellbore during milling out of the plug(s) (see FIG. 3). The milling may occur, for example, via coiled tubing (CT), hydraulic workover (HWO), or a drilling rig. The activator may be added to a circulation fluid through the bit, for example. In some examples, steps 404 to 406 may occur after each other.

Accordingly, the methods of the present disclosure improve proppant flowback control and may be performed during fracking, a plug and perf completion, and/or milling of a plug. The methods may include any of the various features disclosed herein, including one or more of the following statements.

Statement 1. A method comprises coating resin onto proppant at a well site; pumping the coated proppant into a wellbore during a fracking operation; and pumping an activator for the resin into the wellbore to displace the coated proppant into at least one fracture during the fracking operation, wherein the step of pumping the coated proppant and the step of pumping the activator are performed separately.

Statement 2. The method of the statement 1, further comprising pumping a perforating apparatus attached to a plug, into the wellbore.

Statement 3. The method of any of the preceding statements, further comprising setting the plug such that the coated proppant and the activator are contained in a stage of the wellbore.

Statement 4. The method of any of the preceding statements, further comprising perforating a subsequent stage of the wellbore.

Statement 5. The method of any of the preceding statements, further comprising milling the plug.

Statement 6. The method of any of the preceding statements, wherein the step of coating comprises dry-coating the resin onto the proppant.

Statement 7. The method of any of the preceding statements, wherein the step of coating comprises wet-coating the resin onto the proppant.

Statement 8. A method comprising: coating resin onto proppant at a well site; pumping coated proppant into at least one fracture extending from a wellbore; pumping an activator for the resin into the wellbore, wherein the step of pumping the coated proppant and the step of pumping the activator are performed separately; and displacing the activator from the wellbore into the at least one fracture with a perforating apparatus attached to a plug.

Statement 9. The method of the statement 8, further comprising setting the plug such that the coated proppant and the activator are contained in a stage of the wellbore.

Statement 10. The method of the statement 8 or the statement 9, further comprising perforating a subsequent stage of the wellbore.

Statement 11. The method of any of the statements 8-10, further comprising milling the plug.

Statement 12. The method of any of the statements 8-11, wherein the step of coating comprises coating the resin onto the proppant during a fracking operation.

Statement 13. The method of any of the statements 8-12, wherein the step of coating comprises coating the resin onto the proppant that is positioned on a sand screw during a fracking operation.

Statement 14. A method comprising: coating resin onto proppant at a well site; pumping coated proppant into at least one fracture extending from a wellbore; setting a plug in the wellbore; and pumping an activator for the resin into the wellbore during an operation to mill the plug, wherein the step of pumping the coated proppant and the step of pumping the activator are performed separately.

Statement 15. The method of the statement 14, wherein the step of coating comprises applying a furan resin onto the proppant.

Statement 16. The method of the statement 14 or the statement 15, wherein the step of coating comprises applying a furan resin onto sand.

Statement 17. The method of any of the statements 14-16, wherein the step of coating comprises adding the resin into mixing equipment during a fracking operation.

Statement 18. The method of any of the statements 14-17, wherein the step of coating comprises coating the resin onto the proppant that is positioned on a sand screw during a fracking operation.

Statement 19. The method of any of the statements 14-18, wherein the step of pumping the activator comprises passing the activator through milling equipment.

Statement 20. The method of any of the statements 14-19, wherein the step of pumping the activator comprises pumping an acid or an ester into the wellbore.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

coating resin onto proppant at a well site to provide coated proppant;

pumping the coated proppant into a wellbore during a fracking operation;

pumping an activator for the resin into the wellbore, the activator configured to harden the resin to consolidate loose particles;

flushing the coated proppant into at least one fracture with the activator during the fracking operation, wherein the pumping of the coated proppant and the pumping of the activator are performed separately;

introducing a plug and a perforating apparatus into the wellbore, wherein the plug is attached to the perforating apparatus; and pumping the plug and the perforating apparatus along the wellbore; and displacing the activator in a downhole direction with the plug.

2. The method of claim 1, further comprising setting the plug.

3. The method of claim 2, further comprising containing the coated proppant and the activator within a stage of the wellbore.

4. The method of claim 3, further comprising perforating a subsequent stage of the wellbore.

5. The method of claim 4, further comprising removing the perforating apparatus from the plug and the wellbore, and placing a tool with a bit into the wellbore to mill the plug with the bit.

6. The method of claim 1, wherein the coating of the resin onto the proppant comprises dry-coating the resin onto the proppant at the well site.

7. The method of claim 1, wherein the coating of the resin onto the proppant comprises wet-coating the resin onto the proppant at the well site.

8. A method comprising:

coating resin onto proppant at a well site to provide coated proppant;

pumping the coated proppant into at least one fracture extending from a wellbore;

pumping an activator for the resin into the wellbore, wherein the pumping of the coated proppant and the pumping of the activator are performed separately, the activator configured to harden the resin to consolidate loose particles;

positioning a perforating tool in the wellbore; and displacing the activator from the wellbore into the at least one fracture with a plug that is attached to the perforating tool.

9. The method of claim 8, further comprising setting the plug and containing the coated proppant and the activator in a stage of the wellbore.

10. The method of claim 9, further comprising perforating a subsequent stage of the wellbore.

11. The method of claim 8, further comprising removing the perforating tool and placing a tool with a bit into the wellbore to mill the plug with the bit.

12. The method of claim 8, wherein the coating of the resin onto the proppant comprises coating the resin onto the proppant in mixing equipment during a fracking operation.

13. The method of claim 8, wherein the coating of the resin onto the proppant comprises coating the resin onto the proppant that is positioned on a sand screw during a fracking operation.

14. A method comprising:

coating resin onto proppant at a well site to provide coated proppant;

pumping the coated proppant into at least one fracture extending from a wellbore;

setting a plug in the wellbore;

positioning a tool with a bit in the wellbore; and pumping an activator for the resin into the wellbore while milling the plug with the bit, wherein the pumping of the coated proppant and the pumping of the activator are performed separately, the activator configured to harden the resin to consolidate loose particles.

15. The method of claim 14, wherein the coating of the resin onto the proppant comprises applying a furan resin onto the proppant.

16. The method of claim 14, wherein the coating of the resin onto the proppant comprises applying a furan resin onto sand.

17. The method of claim 14, wherein the coating of the resin onto the proppant comprises adding the resin into mixing equipment during a fracking operation.

18. The method of claim 14, wherein the coating of the resin onto the proppant comprises coating the resin onto the proppant that is positioned on a sand screw during a fracking operation.

19. The method of claim 14, wherein the pumping of the activator comprises passing the activator through milling equipment.

20. The method of claim 14, wherein the pumping of the activator comprises pumping an acid or an ester into the wellbore.

* * * * *